United States Patent [19]

Wirtgen

[11] 4,335,974

[45] Jun. 22, 1982

[54] MACHINE FOR COATING MILLED OR PEELED ROAD SURFACES

[76] Inventor: Reinhard Wirtgen, Hohner Strasse 2, 5461 Windhagen, Fed. Rep. of Germany

[21] Appl. No.: 107,388

[22] Filed: Dec. 26, 1979

[30] Foreign Application Priority Data

Dec. 29, 1978 [DE] Fed. Rep. of Germany ..... 2856635

[51] Int. Cl.[3] ..... E01C 23/12

[52] U.S. Cl. ..... 404/92; 404/101; 404/91

[58] Field of Search ..... 404/92, 91, 90, 101

[56] References Cited

U.S. PATENT DOCUMENTS

| | | | |
|---|---|---|---|
| 1,938,755 | 12/1933 | Swearingen | 404/91 |
| 1,953,890 | 4/1934 | Allen | 404/92 |
| 2,059,607 | 11/1936 | Pullar | 404/92 |
| 2,064,365 | 12/1936 | Wallace | 404/92 |
| 2,069,376 | 2/1937 | Madsen | 404/92 |
| 2,159,509 | 5/1939 | Mosel | 404/92 |
| 2,169,406 | 8/1939 | Cost | 404/92 |
| 2,201,493 | 5/1940 | Jorgensen | 404/92 |
| 2,328,888 | 9/1943 | Bell | 404/92 |
| 2,481,679 | 9/1949 | Miller | 404/92 X |
| 3,361,042 | 1/1968 | Cutler | 404/92 X |
| 3,561,335 | 2/1971 | Leatherman | 404/92 |
| 4,008,975 | 2/1977 | Cutler | 404/101 |
| 4,011,023 | 3/1977 | Cutler | 404/91 |

*Primary Examiner*—Nile C. Byers, Jr.

*Attorney, Agent, or Firm*—Steinberg & Raskin

[57] ABSTRACT

The invention relates to a machine for providing milled or peeled road surfaces with a coating, comprising a chassis including a drive motor and having in the front portion thereof a supply or storage container for the material to be applied and in the rear portion thereof a plank-shaped finisher wherein between said supply container and said finisher a mixing device is disposed, which is provided with a first conveyor device feeding the material from said supply container and a second conveyor device feeding the milled-off or peeled material from the ground.

8 Claims, 5 Drawing Figures

Figure 1:
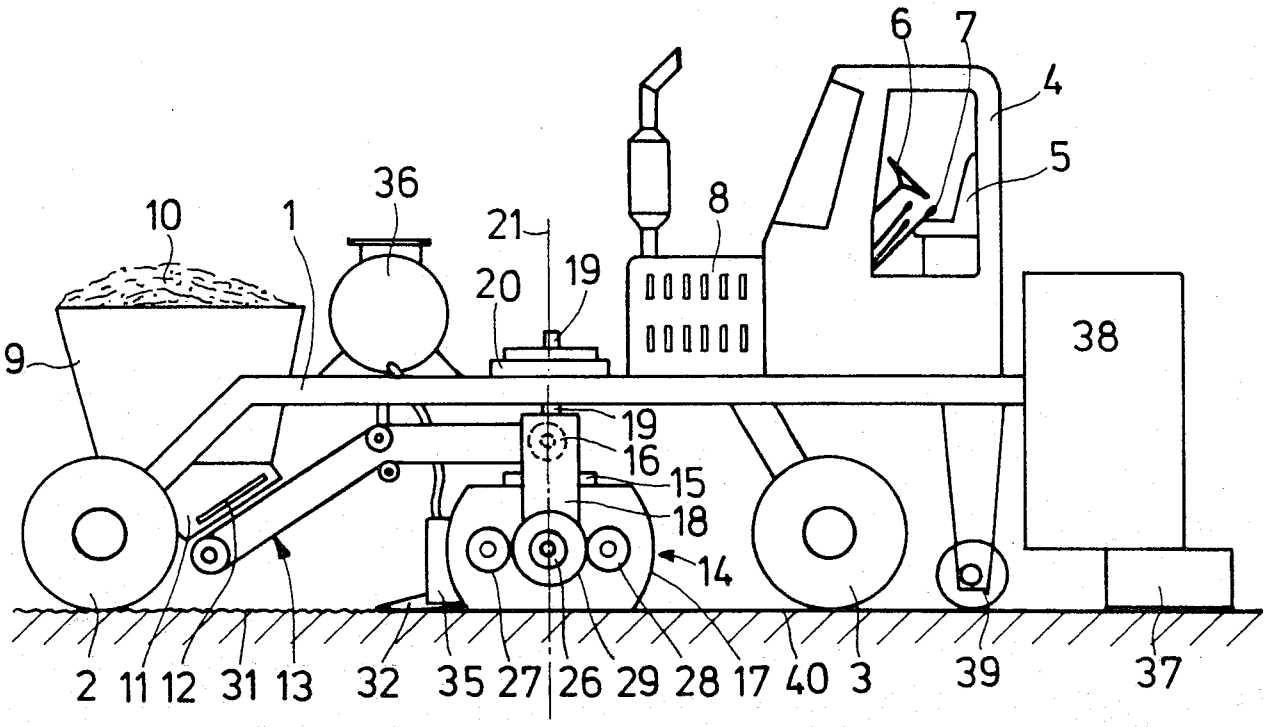

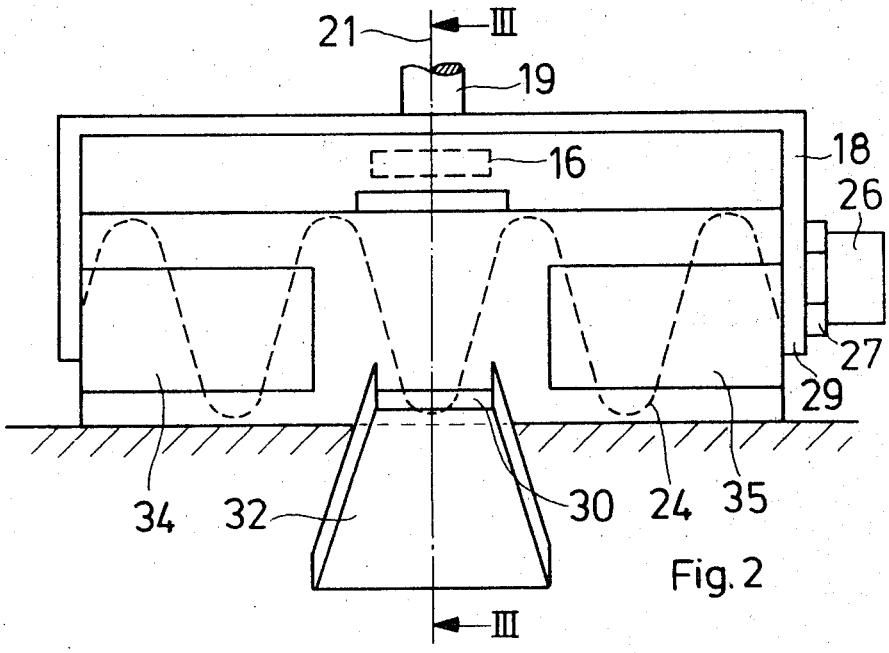
Fig. 2
Fig. 3
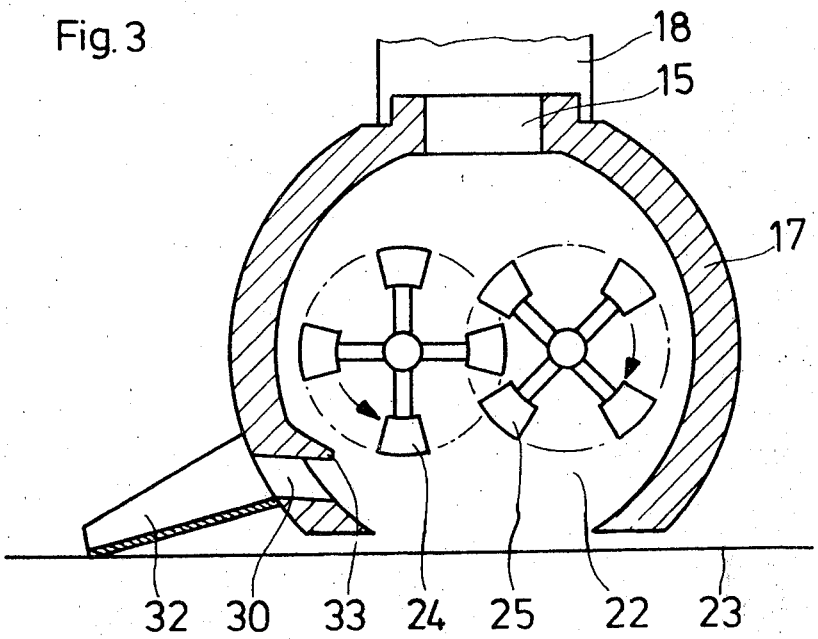

MACHINE FOR COATING MILLED OR PEELED ROAD SURFACES

The invention relates to a machine for providing milled or peeled road surfaces with a coating comprising a chassis including a drive motor and having in the front portion thereof a supply or storage container for the material to be applied and in the rear portion thereof a plank-shaped finisher.

When renewing road surfaces damaged by atmospheric influences or by a high density of vehicles, the road surface is first milled or peeled and when the milled-away or peeled-off material has been removed, a new coating is applied. In the course of the milling or peeling as well as in the course of the application of the new coating, the milled or peeled road surface may be subjected to a heating which simplifies the milling or peeling on one hand and provides for a better adhesion of the new coating on the underground, on the other. The milled or peeled material is loaded into trucks and is transported by them to dumping sites.

In order to keep the mending costs per road length unit as low as possible, the milled or peeled material is, in accordance with a prior suggestion, not transported to a dumping site but is rather reimployed for the coating of the milled or peeled road surface. According to this method, the socalled recycling method, the milled or peeled material is mixed together with the new coating material in a ratio conforming to the corresponding requirements and this mixture is then applied onto the milled or peeled road surface.

In the prior art machines for coating milled or peeled road surfaces, mixing of the milled or peeled material with the new coating material is performed in a separate process and the material mixture is subsequently transported by a truck to the storage container of the coating machine. Although the mending costs per road length unit may considerably be lowered by this procedure as compared to the prior art methods, relatively high transport efforts are still necessary causing correspondingly high costs.

By the present invention, it is intended to overcome this disadvantage. It is therefore the aim of the present invention to so improve the prior art machines for coating milled or peeled road surfaces that the application of the new coating in accordance with the recycling method may be performed with the least effort of time and money.

Starting from a machine of the kind described in the beginning, this problem is solved in that between the supply or storage container and the finished a mixing device is disposed, which is provided with a first conveyor device feeding the material from the supply container and a second conveyor device feeding the milled-off or peeled material from the ground.

By this feature, the transport effort is reduced to a minimum as only the new material has to be transported to the coating machine. No removal of milled or peeled material will be necessary, it may rather rest on the milled or peeled surface until it is seized by the coating machine and fed to its mixing device. A particular advantage of the invention is seen in that the mixing ratio of milled or peeled material and of the new material may be adjusted on the site so that an optimum adaptation of the mixing ratio to the underground, to different milling depths, different composition of the milled or peeled material and other locally different requirements is possible.

In accordance with an advantageous embodiment of the invention, the first conveyor device is a conveyor belt one end of which is under a discharge opening of the supply or storage container and the other end of which is above the filling opening of the mixing device. A further advantageous embodiment is seen in that the first conveyor device is a screw conveyor comprising a conveyor worm provided in a tube terminating under the discharge opening of the supply container on one hand and above the filling opening of the mixing device on the other. Such an embodiment has the advantage as compared to the first described one, that there is a more uniform transport of the material from the supply container to the mixing device and therefore the mixture comprising the material from the supply container and the milled or peeled material from the road surface may more precisely be adjusted. This is essentially due to the fact that the screw conveyor provides for a transport even if the material in the storage container becomes clotty while the belt of a belt conveyor would run empty in such a case. It is of a certain disadvantage that the maintenance costs are higher in case of a screw conveyor than in a belt conveyor and there is particularly the danger that the screw conveyor might become clogged. Which of the two conveyors is to be employed in the end, will have to be decided with a view to the requirements.

For an exact adjustment of the mixing ratio of the material transported from the supply container and of the milled or peeled material, it is most suitable to provide a conveyor of variable conveying speed. By increasing or decreasing the conveying speed and if the discharge from the supply container is uniform, the amount of the material transported to the mixing device may be enlarged or decreased. Another possibility of realization is seen in providing the supply container with a discharge opening of variable cross section of the opening. It should be mentioned however that in case of such a discharge opening a correct dosing is possible only above a certain transporting amount because if the cross section of the opening dependent from the flowing properties of the material is too small, uniform discharge will not be possible. It is also possible to provide in combination a conveyor having variable conveying speed as well as a supply container having a discharge opening of variable opening cross section.

In accordance with an advantageous embodiment of the invention, the second conveying device comprises shoving and conducting sheets, which collect the peeled or milled material, which is on the milled or peeled road surface, and guide it to a filling opening in the mixing device. Depending on whether the milling or peeling device has assembled the milled or peeled material in the middle area of the milled or peeled road surface or whether it has left the milled or peeled material on the whole road surface being processed, the shoving and conducting sheets may either be restricted to the middle area or should extend over the total width of the road surface being treated. In order to also seize small-grained milled or peeled material with the second conveyor device, it is recommended to provide brooms in the range of the shoving and conducting sheets. Worm shaped brooms rotating around the longitudinal axis thereof have shown to be particularly suitable.

In an advantageous embodiment of the invention, the mixing device comprises two mixing rollers rotating opposite relative to each other, supported in a housing having a filling opening for the first conveyor device at the upper side and a filling opening for the second conveyor device in the area of the underside. The filling opening for the second conveyor device is so shaped that the milled or peeled material may enter the mixing device, the material already in the mixing device however cannot leave it through the filling opening. To this end, a projection may be provided in the interior of the housing of the mixing device above the filling opening for the second conveyor device which passes the flow of material directed from top to bottom along the opening.

It has shown to be particularly advantageous to provide the housing of the mixing device with an underside open to the road surface. In this case, the housing forms, together with the road surface, an almost closed mixing chamber where however the material being mixed may, to a certain extent, escape between the lower edge of the housing and the road surface. If in accordance with an advantageous further development the mixing device is vertically adjustable on the chassis, the distance of the underside of the housing of the mixing device to the road surface, and thus the thickness of the track of material emerging from the interior space of the mixing device, may be adjusted. If furtheron the mixing device is tiltingly secured around an essentially perpendicular axis to the chassis, the width of the track of material may, by correspondingly tilting the mixing device, be adjusted within wide ranges.

It is obvious that the mixing devices of other types may be employed as well such as a common drum mixer including a mixing drum rotating around a horizontal shaft. Particularly in case of such a drum mixer, the charging with the material collected on the road surface is not so simple as charging should be performed at the upper edge of the drum and the material must therefore be transported by means of a further transport device from the road surface level onto the level of the upper edge of the drum. All the other mixing devices have in common the disadvantage that a particular discharge opening for the mixed material has to be provided which, as has shown, might easily get clogged. The latter is not the case in a mixing device having an underside open on the road surface.

For the vertical adjustment of the mixing device and also for tilting it around an essentially perpendicular axis, hydraulic servomotors are suitably provided. As compared to other electric or pneumatic servomotors, they have the advantage that they may be incorporated into the hydraulic network already provided on the machine.

It has shown to be suitable to provide a liquid gas driven heating device for heating the milled or peeled road surface ahead of the milling device in the travelling direction. By this heating device, the milled or peeled road surface may be heated on one side, which brings about, as has been mentioned above, an improvement of the adhesion of the new road coating on the milled or peeled surface, and the milled or peeled material, which is subsequently transported to the mixer, on the other. The heating of the milled or peeled material prior to, or in the course of, the mixing process, if desired also together with the material transported from the storage container to the mixing device, leads to particularly favorable mixing ratios. The latter may be improved only in that the heating device is secured to the mixing device and the heat generated by the heating device may thus penetrate via the housing of the mixing device into the interior thereof.

In accordance with an advantageous embodiment of the invention, a device distributing the coating material to be applied to the processed road surface is provided behind the mixing device in travelling direction. Such a device is of particular advantage if and when mixing devices of a different type are employed instead of the aforementioned mixing device because in the former the uniformity of the discharge may be subjected to substantial variations. This device may however also be of advantage if in special cases the machine works without a mixer, i.e. only the material from the storage container is to be applied onto the milled or peeled and cleaned road surface. In that case, the material is passed from the storage container via the first conveyor device into the mixing device which is in another position and through which the material drops directly to the milled or peeled surface. As the device distributing the coating material, a grading worm is provided.

The invention will now be explained in more detail based on the drawing which includes, partly in a schematic illustration, an exemplified embodiment.

Figure 4:
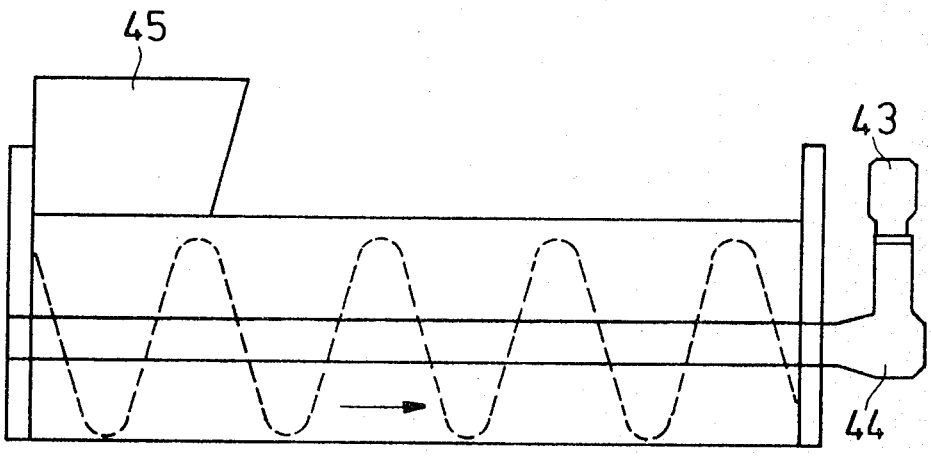
Figure 5:
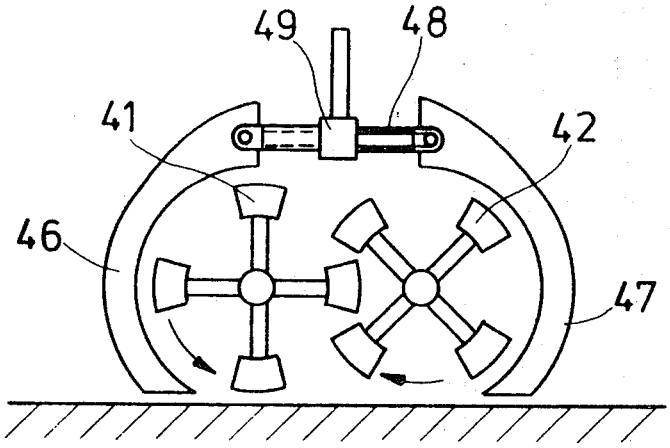

FIG. 1 is a side view of a machine for coating milled or peeled road surfaces, FIG. 2 is a front view of the mixing device of the machine according to FIG. 1, FIG. 3 is a cross section of the mixing device according to FIG. 2 along the line III—III, FIG. 4 is a schematic side view of another mixing device according to the present invention, and FIG. 5 is a front view of this mixing device according to FIG. 4.

The chassis 1 of the coating machine is provided with a steerable front wheel pair 2 and a driven rear wheel pair 3. In the rear portion of chassis 1, there is the driver's cabin 4 including a seat 5, a steering wheel 6, and various operating levers 7. In front of the driver's cabin, the drive motor 8 of the machine is located.

In the front portion of chassis 1, a storage or supply container 9 for the material 10 to be applied is provided. Storage container 9 includes a discharge opening 11, the opening cross section of which may be varied by means of a slide 12. Below discharge opening 11, there is one end of belt conveyor 13, which transports the material 10 from the storage container 9 to a mixing device 14.

The mixing device 14 includes a central filling opening 15 for the material 10 above which the discharge end 16 of belt conveyor 13 is provided. The mixing device 14 comprises a housing 17 supported in a holder 18 which on its part is connected to the movable part 19 of an hydraulic motor 20. By correspondingly controlling the hydraulic motor 20, holder 18, and thus the whole mixing device, may be lifted and lowered and tilted around axis 21.

Housing 17 of the mixing device 14 is open at its underside so that the mixing space 22 is defined by the housing wall on one side and by the ground surface 23 on the other. In the interior 22, two mixing rollers 24 and 25 rotate in an opposing direction relative to each other. Operation of the two mixing rollers 24 and 25 is performed by means of an hydraulic motor 26 as well as a gear comprising three tooth wheels 27, 28 and 29.

On the front side of housing 17, there is an inlet aperture 30 for the milled or peeled material 31 on the ground surface 23. This material has already been assembled in the middle range of the road surface to be processed so that a shoving sheet 32 having a relatively small reception area is sufficient for the collection of the material. In the interior 22 of housing 17, above opening 30, there is a projection 33, which keeps the material rotated in the interior 22 away from opening 30.

On the front side of the mixing device, two heating devices 34 and 35 are furtheron provided fed with liquid gas from a liquid gas tank 36.

Between plank-shaped finisher 37 loaded with a weight 38 and the rear wheel pair 3, there is a grader worm 39 by which the coating material 40 applied onto the road surface to be treated is uniformly distributed ahead of the finisher 37.

The mixer illustrated in FIGS. 4 and 5 is suitably mounted in parallel relative to the longitudinal axis of the machine, preferably in the middle under the chassis, so that the two mixing rollers 41 and 42 rotate in parallel relative to the longitudinal axis of the machine the former being driven by the hydraulic motor 43 via a miter gear 44. On the front side opposite to the hydraulic motor, the milled material is seized while the aggregates required for the production of the desired road surface material are added via filling opening 45.

The materials to be mixed pass the mixer and escape from the front side where the drive of the mixer rollers is located.

As shown in FIG. 5 in detail, the two mixer shovels 41 and 42 are provided in a housing open to the road surface.

The milled material collected by the shoving sheets arrives automatically into the reaction area of the two mixer shovels 41 and 42 and is intimately mixed together with the aggregate filled via funnel 45 and is then, after leaving the mixer, uniformly distributed over the milled road surface by grader worm 39.

The distance relative to each other of the side walls 46 and 47 of the mixer housing may be adjusted by means of worm-gear spindle 48 provided with left and right-hand thread, respectively, and the appropriate ratchet 49. In this way, the mixing intensity of the mixer may indefinitely be varied.

I claim:

1. In apparatus for coating stripped road surfaces with a new surface material constituted by a mixture of material previously stripped from the road and a new material, comprising:

a vehicle including a chassis and a drive motor;

a supply container for the new material carried by said chassis at a front region thereof;

a plank-type finisher for applying the new surface material carried by said chassis at a rear region thereof; and a mixing device carried by said chassis between said supply container and said plank-type finisher, the improvement comprising:

said mixing device comprises a housing in which a pair of rotatable mixers are arranged, said housing having an underside region which opens in opposed relationship to the road surface, said housing being provided with a first filling opening at an upper side region thereof adapted to receive material transported from said supply container and a second filling opening in the area of the underside region thereof adapted to receive the material previously stripped from the road;

first transport means for transporting material at a selectively variable rate from said supply container into said mixing device housing through said first filling opening; and shoving and conducting sheets for collecting material previously stripped from the road and guiding the same into said mixing device housing through said second filling opening.

2. The combination of claim 1 further including means for adjusting the height of said mixing device on said chassis.

3. The combination of claim 1 wherein said mixing device is pivotally secured to said chassis about a substantially vertical axis.

4. The combination of claim 1 wherein said supply container has a discharge opening provided therein and wherein said first transport means comprises a belt conveyor, one end of said belt conveyor being situated under said discharge opening and the other end of said belt conveyor being situated over said first filling opening of said mixing device.

5. The combination of claim 1 wherein said supply container has a discharge opening provided therein and wherein said first transport means comprises a worm conveyor including a conveyor screw located within a tube, one end of said worm conveyor being situated under said discharge opening and the other end of said worm conveyor being situated over said first filling opening of said mixing device.

6. The combination of claim 1 wherein said supply container has a discharge opening provided therein, said discharge opening being variable in its opening size.

7. The combination of claim 1 further including heating means located forwardly of said mixing device in the direction of travel of said vehicle for heating the material previously stripped from the road prior to it being guided into said mixing device.

8. The combination of claim 7 wherein said heating means are secured to said mixing device in a manner such that the heat generated thereby is transferred through the mixing device housing into the interior thereof.

* * * * *